US009438975B2

(12) United States Patent
Mariasov

(10) Patent No.: US 9,438,975 B2
(45) Date of Patent: Sep. 6, 2016

(54) NOVELTY ARTICLE OF ATTIRE OR ACCESSORY

(71) Applicant: Alexander Mariasov, Las Vegas, NV (US)

(72) Inventor: Alexander Mariasov, Las Vegas, NV (US)

( * ) Notice: Subject to any disclaimer, the term of this patent is extended or adjusted under 35 U.S.C. 154(b) by 91 days.

(21) Appl. No.: 14/190,080

(22) Filed: Feb. 25, 2014

(65) Prior Publication Data

US 2015/0146903 A1 May 28, 2015

Related U.S. Application Data

(60) Provisional application No. 61/908,147, filed on Nov. 24, 2013.

(51) Int. Cl.

| | |
|---|---|
| ***H04R 1/02*** | (2006.01) |
| ***A41D 1/00*** | (2006.01) |
| ***A42B 1/00*** | (2006.01) |
| ***A42B 1/24*** | (2006.01) |

(52) U.S. Cl.

CPC ..... *H04R 1/028* (2013.01); *A41D 1/002* (2013.01); *A42B 1/004* (2013.01); *A42B 1/242* (2013.01); *H04R 2201/023* (2013.01)

(58) Field of Classification Search

CPC .... H04R 1/028; H04R 2499/15; H04R 1/02; H04R 2499/11; H04R 1/025; H04R 2201/023

USPC ..... 381/333

See application file for complete search history.

(56) References Cited

U.S. PATENT DOCUMENTS

| | | | | |
|---|---|---|---|---|
| 6,007,212 | A | 12/1999 | Chan | |
| 6,223,355 | B1 | 5/2001 | Irving | |
| 8,121,335 | B2 * | 2/2012 | Sharpe | A42B 1/248 381/376 |
| 2004/0217868 | A1 * | 11/2004 | Armbruster | G08B 21/0208 340/573.1 |
| 2012/0062571 | A1 * | 3/2012 | Malek | G06F 1/163 345/501 |

* cited by examiner

*Primary Examiner* — Mark Blouin

(74) *Attorney, Agent, or Firm* — Mark David Torche; Patwrite LLC

(57) ABSTRACT

A novelty article of attire including a novelty device. The novelty device includes a visual output/illumination feature; a processor controlling the novelty device; an actuator associated with the processor and actuating the visual output/illumination feature; a sound receiver operably connected to the actuator and the processor; and a power source.

17 Claims, 4 Drawing Sheets

NOVELTY ARTICLE OF ATTIRE OR ACCESSORY

CROSS REFERENCE TO RELATED APPLICATIONS

This application claims priority and herein incorporates by reference U.S. provisional patent application 61/908,147, filed Nov. 24, 2013.

FIELD OF THE INVENTION

The present invention relates to clothing or fashion accessories, in particular a novelty device therefor.

BACKGROUND OF THE INVENTION

Novelty items such as clothing or other such fashion accessories (e.g. hand bags, backpacks, purses and the like) are fun and popular as well as provide an ice breaker to conversation. Additionally, such items can be used for advertisement purposes.

U.S. Pat. No. 6,007,212 (Chan, 1999 Dec. 28) discloses a novelty hat with a blinking light secured to a hat portion. The blinking light has wiring with a power switch coupled with a battery.

U.S. Pat. No. 6,223,355 (Irving, 2001 May 1) describes a decorative hat with a plurality of decorative lights attached to the outside thereof; an electrical power source attached to the inside of the hat; electrical circuitry, and a switch.

U.S. Pat. No. 8,121,335 (Sharpe et al., 2012 Feb. 21) teaches an article of accentuated headwear with an electronic visual display and an audio output device attached thereto. The headwear includes an electronic memory. A processor with a user interface is in data communication with the electronic visual display, the audio output device, and the electronic memory. The processor includes programming to actuate the electronic visual display and the audio output device.

SUMMARY OF THE INVENTION

The present invention relates to a novelty article of clothing, such as a novelty hat, shirt, trousers, shoes; or novelty accessory such as a purse, handbag or the like, in particular, including a novelty feature.

The article of clothing or accessory thereto (also termed a fashion accessory), hereinafter generically referred to as "attire" or derivatives thereof, can include the above-mentioned examples of hat, shirt, trousers, shoes; purse; and handbag; however, also hand fans; parasols; umbrellas; canes; jackets; boots; cravats; ties; bonnets; caps, belts; suspenders; gloves; hand or ear muffs; jewelry; watches; sashes; shawls; scarves; socks; and stockings—and even sunglasses; hair ornaments; hairpins; barrettes and headbands.

The invention provides a novelty article that includes attire with a novelty aspect. The novelty aspect includes an illumination feature (e.g. light, flashing light, colored light, color changing light); an illumination feature fastener (e.g. a clip, hook-and-loop fastener, rivet, adhesive, etc.) to fasten the illumination feature to the article; a power source (e.g. a battery or solar panel) operably attached to and configured to power the illumination feature; a user control interface (e.g. one or more: toggles, buttons or thumb wheel switches) for controlling the novelty aspect; a processor; and a sound receiver (i.e. microphone-like component) operably connected to the processor and possibly also operably connected to the user control interface.

The sound receiver is a feature not commonly a part of novelty attire and can be a particularly special feature in that the sound receiver can provide the attire with a controllable novelty feature, including in real time, by the user/wearer. In other words, the sound receiver can be controlled so that the receiver attenuates or accentuates the incoming sound (i.e. the signal generated by the sound); and that control can be affected in a pre-determined fashion, prior to exposure to any expected sound and/or at the time of the sound. For example, the wearer may control the sound receiver when at a night club to control the illumination feature (illuminator output) so as to provide, for example, a light blue color to soft music or a pulsing red color to loud music with a heavy beat or changing colors to jazzy music. In this regard, the device can be configured so the illumination feature can be responsive to the received sound's beat or decibel level or frequency or a combination thereof, and the like.

In some embodiments, the sound receiver can be configured as a sound activated switch so that the novelty aspect of the attire is not activated unless a certain sound threshold is exceeded.

In particular embodiments, the sound receiver may be configured to control/influence the output of the illumination feature (e.g. control one or more of the illumination feature's intensity, and/or flashing frequency, and/or color—including changing from one color to another or in a series of colors and so on).

In some preferred embodiments, the sound receiver may be configured to include a voice recognition module configured to responds to the user's voice. Selection of the user's voice may be provided after a password entry, which itself can be a voice message.

In some preferred embodiments, the novelty article includes a movement sensor configured so that the article (i.e. the novelty feature) can be activated by movement, including body movement. In some embodiments, the output of the illumination feature (e.g. control one or more of the illumination feature's intensity, flashing frequency, color and so on), can be affected by the body movement (e.g. fast movement causes high intensity light and/or quickly flashing light and the like).

BRIEF DESCRIPTION OF THE DRAWINGS

The present invention will be understood and appreciated more fully from the following detailed description taken in conjunction with the appended drawings in which.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF THE INVENTION

Illustrative embodiments of the invention are described below. In the interest of clarity, not all features/components of an actual implementation are necessarily described.

Figure 1:
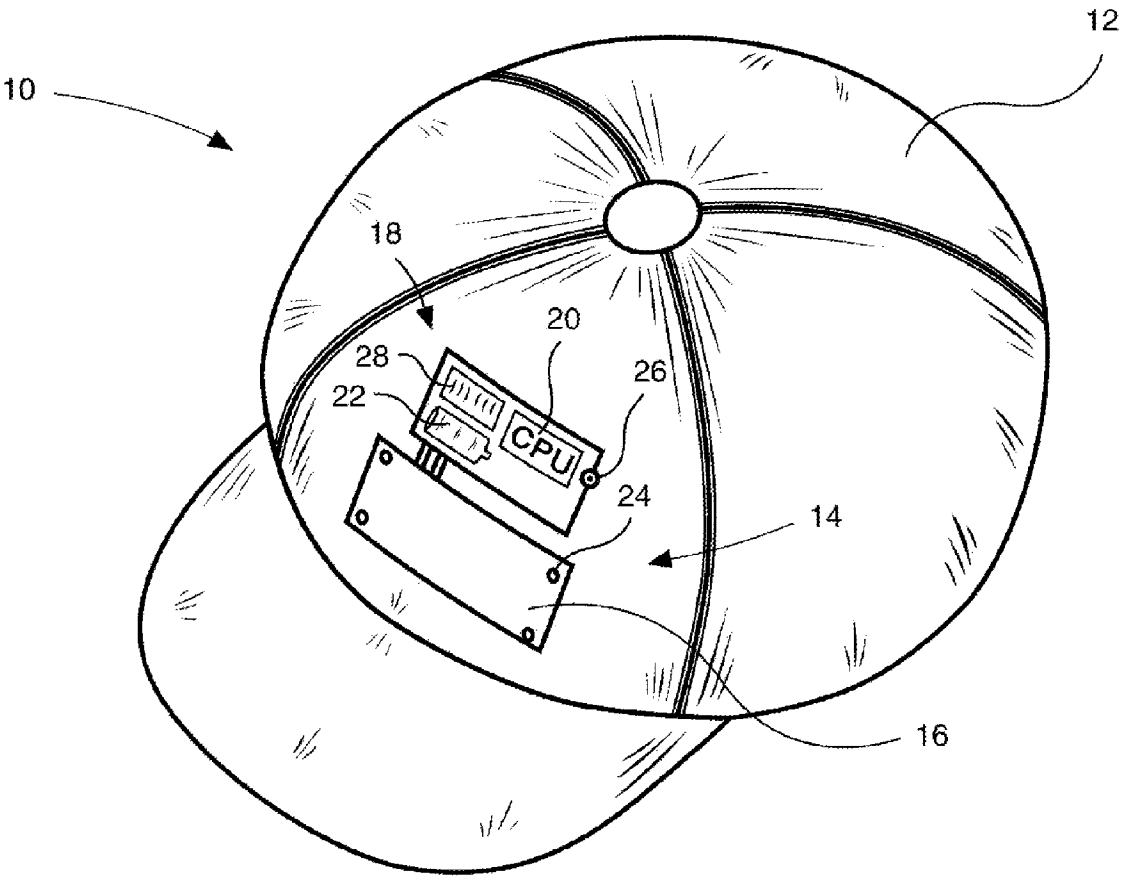
FIG. 1 is a perspective view of some embodiments of a novelty article, in accordance with the present invention, depicted by a novelty hat or cap.

FIG. 1 shows an embodiment of a novelty article 10 including attire 12, exemplified by a cap; and a novelty device 14. Novelty device 14 includes a visual output or illumination feature providable by an illumination panel/illuminator 16 and an actuator. Either integrally included or associated with actuator 18 are a processor 20 and a power source 22, illustrated as a battery (and which can be of a small and light-weight type such as for hearing aids, watches and the like). In some preferred embodiments, illuminator 16 is in the form of a semi-rigid, but yet flexible plastic sheet so that the illuminator can comfortably conform to the shape of the portion of the attire to which the illuminator is attached. Novelty device 14 (in particular illuminator 16 and actuator 18) can be attached to attire 12 by any of a variety of fasteners 24 (e.g. one or more clips, hook-and-loop fasteners, rivets, adhesive, etc. or combination thereof). Actuator 18 is controllable by a user control interface 26, depicted by a thumbwheel switch 26.

In particular embodiments, the novelty article can be designed or adjusted (e.g. via switch 26) whereby actuator has integral or associated therewith a sound receiver or microphone 28, which is communication with processor 20. Processor 20 includes a sound processing module programmed so that illuminator 16 is controllable to the intensity of ambient sound, for example the intensity, frequency, beat or other such feature of the sound—and that illumination feature can be one (or a combination of) flashing, flashing speed, flashing intensity, color, color changes, and so on. For example, thumbwheel switch 26 can be adjusted to thereby control an attenuation feature of processor 20 to control illuminator 16 with respect to the intensity or beat, etc., of the sound or expected sound (e.g. music in a bar or pub).

In some embodiments, sound receiver/microphone 28 or more typically processor 20 may be configured to include a voice recognition module 30 configured to responds to the user's voice. Selection of the user's voice may be provided after a password entry, which itself can be a voice message.

In FIG. 1, actuator 18 is depicted as externally located with respect to attire 12, which can be convenient for quick access and control.

Figure 2:
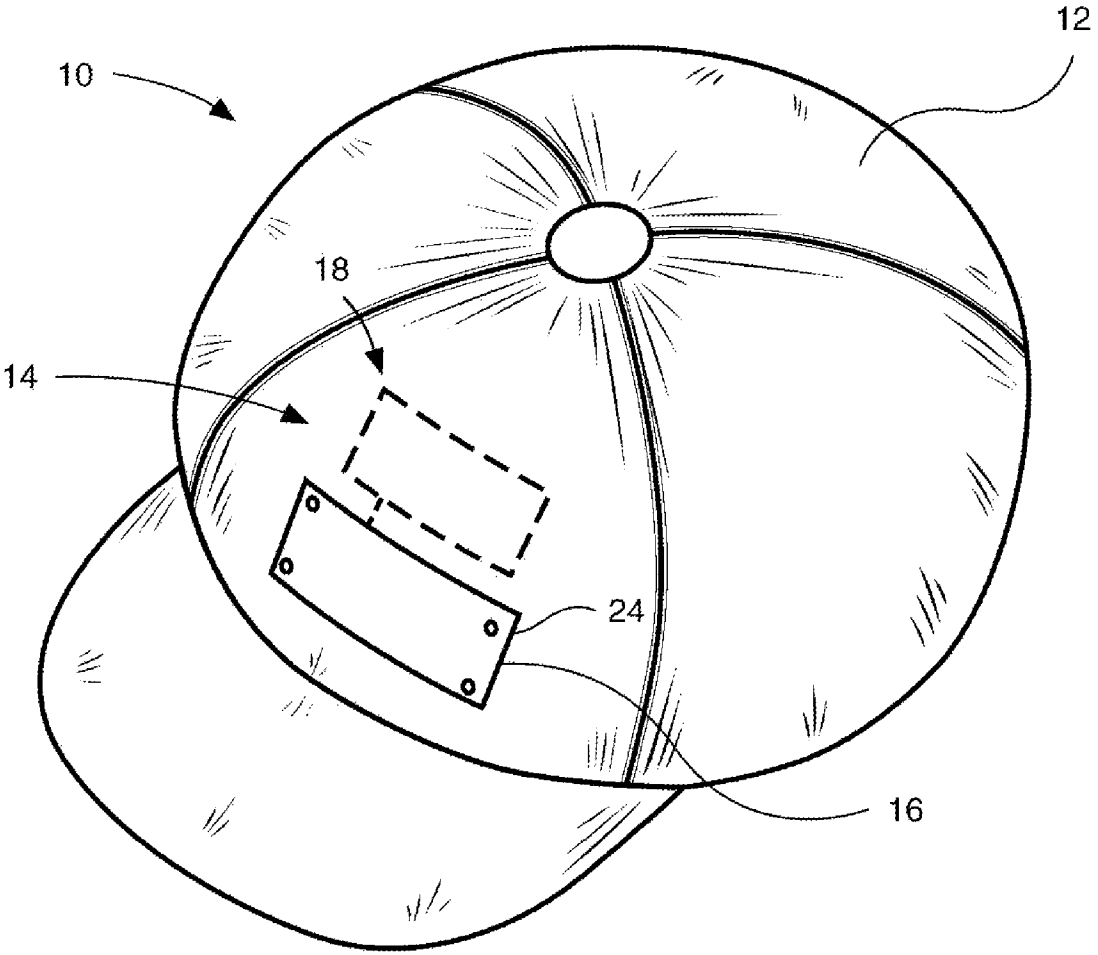
FIG. 2 is a perspective view of an additional embodiment of the novelty article of FIG. 1.

FIG. 2 shows another embodiment wherein actuator 18 is located internal to attire 12, which can be less obtrusive.

Figure 3:
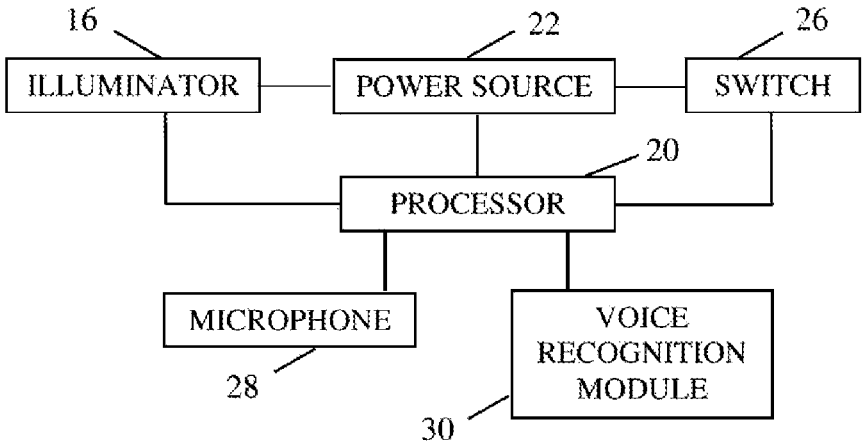
FIG. 3 is a block diagram of the electrical components of the novelty article.

FIG. 3 shows an embodiment of the interaction of the electronic components of the novelty device 14 of the novelty article 10, which were noted above.

Figure 4:
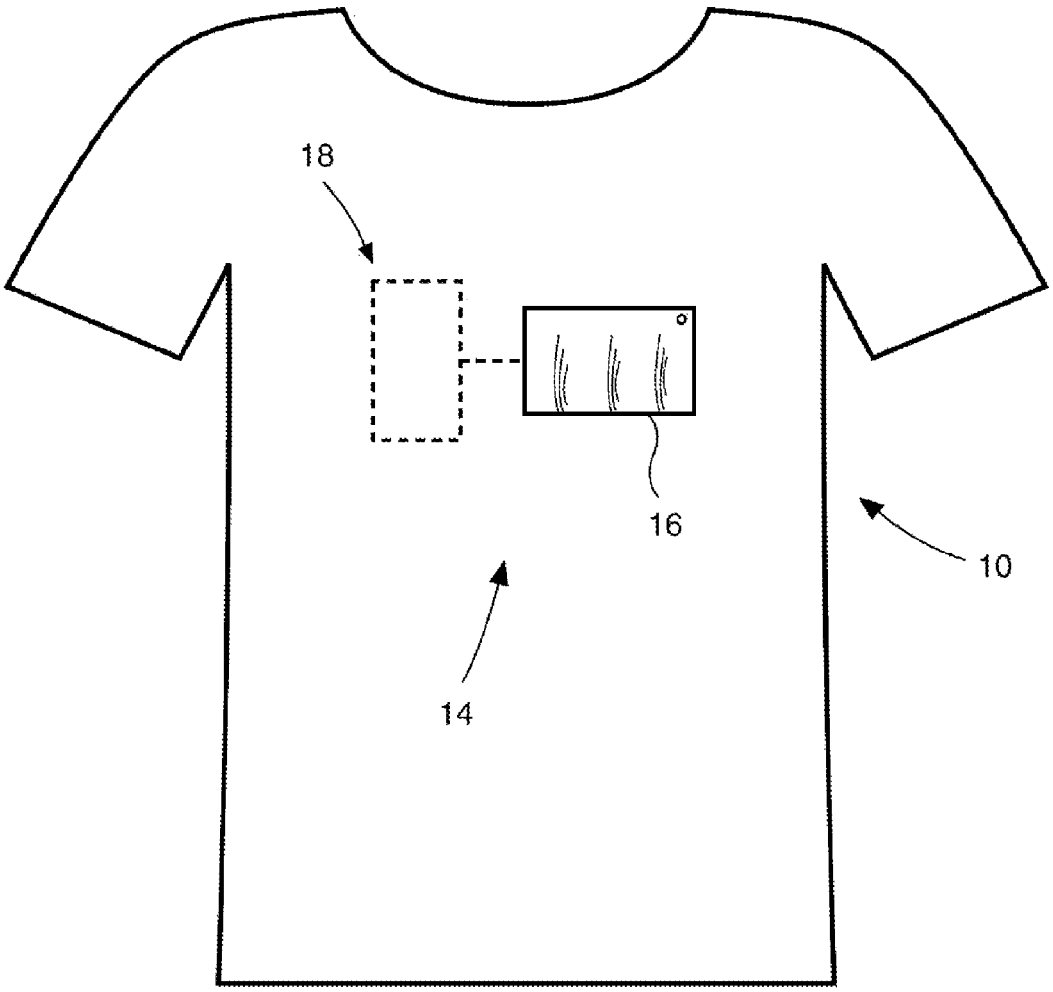
FIG. 4 is a front view of an embodiment of the novelty article in accordance with the present invention, depicted by a novelty shirt.

FIG. 4 shows novelty article 10 including attire 12, exemplified by a shirt. Novelty device 14, in particular, Illumination panel/illuminator 16 thereof is located, for example, in a generally central area at chest height. Actuator 18 is depicted as on the inside of the shirt; however, the actuator can alternatively be on the outside of the shirt.

It is noted that certain components described above and depicted in the associated figures may be implemented as integral components or as separate components.

List of main components: novelty article 10; attire 12; novelty device 14; illumination panel/illuminator 16; actuator 18; processor 20; power source 22; fasteners 24; control interface 26, depicted by a thumbwheel switch 26; sound receiver/microphone 28; and voice recognition module 30.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

What is claimed is:

1. A novelty article of attire comprising:

a novelty device including a visual output/illumination feature fastened to the article of attire;

a processor configured to control the novelty device;

an actuator operably associated with the processor and configured to actuate the visual output/illumination feature;

a sound receiver integral with or associated with the actuator and operably connected to the processor; and a power source configured to power the processor, visual output/illumination feature and the sound receiver;

wherein the sound receiver is configured so that the visual output/illumination feature is controllably responsive to a sound feature received by the sound receiver, the sound feature being a musical beat or sound/audio frequency so that a different beat rate and/or pattern and/or a different audio pitch produces a visual output/illumination with respect to the beat repetition/pattern or pitch.

2. The attire of claim 1, wherein the sound feature further includes a decibel level.

3. The attire of claim 1, wherein the visual output/illumination feature is a flashing, non-flashing or colored light.

4. The attire of claim 3, wherein the light changes color in response to a sound feature.

5. The attire of claim 3, wherein the light changes intensity in response to the sound feature.

6. The attire of claim 3, wherein the light flashes at varied rates in response to a sound feature.

7. The attire of claim 1, wherein the visual output/illumination feature is an illumination panel/illuminator.

8. The attire of claim 1, wherein the attire is a hat or cap.

9. The attire of claim 1, wherein the attire is a shirt.

10. The attire of claim 1, wherein the illuminator is a semi-rigid yet flexible plastic sheet.

11. The attire of claim 1, wherein the actuator is located externally with respect to the attire.

12. The attire of claim 1, wherein the actuator is located internally with respect to the attire.

13. The attire of claim 1, wherein the sound receiver or processor is configured to include a voice recognition module.

14. The attire of claim 1, wherein the actuator is controllable by a user control interface.

15. The attire of claim 14, wherein the user control interface is a thumbwheel switch.

16. The attire of claim 1, further comprising a movement sensor configured so that the novelty feature can be activated by movement, including body movement.

17. The attire of claim 16, wherein the illumination feature can be affected by the body movement.

* * * * *